US010820635B2

(12) United States Patent
Blibech

(10) Patent No.: US 10,820,635 B2
(45) Date of Patent: Nov. 3, 2020

(54) BRA ADAPTED FOR ATHLETIC USE

(71) Applicant: HANES OPERATIONS EUROPE SAS, Rueil-Malmaison (FR)

(72) Inventor: Ragheb Blibech, Paris (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 333 days.

(21) Appl. No.: 15/551,265

(22) PCT Filed: Feb. 25, 2016

(86) PCT No.: PCT/IB2016/051042
§ 371 (c)(1),
(2) Date: Aug. 15, 2017

(87) PCT Pub. No.: WO2016/135673
PCT Pub. Date: Sep. 1, 2016

(65) Prior Publication Data

US 2018/0035724 A1 Feb. 8, 2018

(30) Foreign Application Priority Data

Feb. 25, 2015 (FR) ..... 15 51627

(51) Int. Cl.
*A41C 3/00* (2006.01)
*A41C 5/00* (2006.01)
*A41C 3/12* (2006.01)

(52) U.S. Cl.
CPC ..... *A41C 3/0057* (2013.01); *A41C 3/0021* (2013.01); *A41C 3/12* (2013.01); *A41C 5/005* (2013.01); *A41B 2500/54* (2013.01)

(58) Field of Classification Search
CPC ..... A41C 3/0057; A41C 3/0021
See application file for complete search history.

(56) References Cited

U.S. PATENT DOCUMENTS 911,204 A 2/1909 Busby
1,190,602 A * 7/1916 Sorkin ..... A41C 3/0057 450/1

(Continued)

FOREIGN PATENT DOCUMENTS

CN 100415130 C 9/2008
CN 102894490 C 1/2013

(Continued)

OTHER PUBLICATIONS

Korean Office Action in Korean Application No. KR10-2017-7026872, datd Jul. 10, 2018, 25 pages.

(Continued)

*Primary Examiner* — Goria M Hale
*Assistant Examiner* — Brieanna Szafran
(74) *Attorney, Agent, or Firm* — Fish & Richardson P.C.

(57) ABSTRACT

The disclosure concerns a bra adapted for athletic use, of the type comprising a first cup and a second cup, each of them bounded laterally by an outer edge and by an inner edge, and outfitted with a support structure and a base structure. Each cup is outfitted with a support structure connected to a base structure, the support structure comprising at least a first support strap of overall cradle shape which is elastically deformable and which extends at least from the outer edge to the inner edge of the respective cup to support the breasts of the wearer.

27 Claims, 2 Drawing Sheets

(56) References Cited

U.S. PATENT DOCUMENTS

| | | | | | |
|---|---|---|---|---|---|
| 1,904,644 | A | * | 4/1933 | Le May | A41C 3/0021 450/59 |
| 2,438,210 | A | * | 3/1948 | Gluckin | A41C 3/0021 450/59 |
| 2,440,826 | A | * | 5/1948 | Lo Cascio | A41C 3/0021 450/60 |
| 2,454,151 | A | * | 11/1948 | Glick | A41C 3/0021 450/41 |
| 2,475,624 | A | * | 7/1949 | Laszlo | A41C 3/00 450/63 |
| 2,484,440 | A | * | 10/1949 | Witkower | A41C 3/0021 450/59 |
| 2,486,414 | A | * | 11/1949 | Sayers | A41C 3/0021 450/59 |
| 2,543,984 | A | | 3/1951 | Panes | |
| 2,553,225 | A | * | 5/1951 | Weaver | A41C 3/0021 450/59 |
| 2,607,038 | A | * | 8/1952 | Spare | A41C 3/0021 450/59 |
| 2,946,334 | A | | 7/1960 | Bianco | |
| 3,372,698 | A | | 3/1968 | Gingras | |
| 3,459,190 | A | | 8/1969 | Frischer et al. | |
| 3,506,014 | A | * | 4/1970 | Sorenson | A41C 3/0021 450/60 |
| 3,545,445 | A | | 12/1970 | Freedman | |
| 3,908,670 | A | * | 9/1975 | Dubin | A41C 3/0021 450/58 |
| 4,254,777 | A | * | 3/1981 | Johnston | A41C 3/142 450/41 |
| 4,325,378 | A | * | 4/1982 | Wilkinson | A41C 3/02 450/58 |
| 4,444,191 | A | * | 4/1984 | Harned | A41C 3/0057 450/58 |
| 4,781,651 | A | * | 11/1988 | Ekins | A41C 3/0057 450/25 |
| 4,909,771 | A | | 3/1990 | Bergman | |
| 5,797,787 | A | | 8/1998 | Kaye | |
| 6,213,842 | B1 | | 4/2001 | Degirmenci | |
| 6,425,800 | B1 | | 7/2002 | Huang | |
| 6,837,771 | B2 | | 1/2005 | Falla | |
| 6,966,815 | B2 | | 11/2005 | Weinerth | |
| 7,089,597 | B2 | | 8/2006 | Horii et al. | |
| 7,438,625 | B2 | | 10/2008 | Tremblay et al. | |
| 7,938,710 | B2 | | 5/2011 | Silverman et al. | |
| 8,506,350 | B1 | | 8/2013 | Silverman et al. | |
| 8,753,170 | B1 | | 6/2014 | Silverman et al. | |
| 10,123,575 | B2 | * | 11/2018 | Funk-Danielson | A41C 3/128 |
| 2011/0143633 | A1 | | 6/2011 | Zhang | |
| 2012/0028541 | A1 | * | 2/2012 | Donnelly | A41C 3/0021 450/86 |
| 2012/0156962 | A1 | * | 6/2012 | Krawchuk | A41C 1/06 450/92 |
| 2014/0213145 | A1 | | 7/2014 | McKeen | |
| 2016/0227846 | A1 | * | 8/2016 | Funk-Danielson | A41C 3/128 |
| 2019/0174840 | A1 | * | 6/2019 | Paulson | A41C 3/0014 |
| 2019/0174841 | A1 | * | 6/2019 | Bastug | A41C 3/0057 |

FOREIGN PATENT DOCUMENTS

| | | | |
|---|---|---|---|
| JP | 11-158704 | | 6/1999 |
| JP | 2013072161 | A | 4/2013 |
| JP | 2014214400 | A | 11/2014 |
| KR | 2005103188 | A | 10/2005 |
| WO | WO2004049839 | A | 6/2004 |
| WO | WO2014207379 | | 12/2014 |

OTHER PUBLICATIONS

International Search Report/Written Opinion issued by the European Patent Office as ISA dated May 4, 2016; 29 pages.

Austrailian Office Action in Austrailian Application No. 2016224876, dated Dec. 21, 2017, 3 pages.

International Preliminary Report on Patentability in International Application No. PCT/IB2016/051042, dated Aug. 29, 2017, 7 pages.

Chinese Office Action in Chinese Application No. 201680012307, dated Aug. 2, 2018, 18 pages.

Chinese Office Action in Chinese Application No. 201680012307, dated Apr. 18, 2019, 19 pages.

European Office Action in European Application No. 16707229.7, dated Oct. 29, 2018, 5 pages.

Candian Office Action in Candian Application No. 2977176, dated Jun. 7, 2018, 4 pages.

Korean Office Action in Korean Application No. KR10-2017-7026872, dated Jan. 10, 2019, 6 pages.

EP Office Action in European Appln. No. 16707229.7, dated Apr. 20, 2020, 5 pages.

* cited by examiner

BRA ADAPTED FOR ATHLETIC USE

TECHNICAL FIELD

The disclosure concerns a reinforced-support bra adapted for athletic use.

BACKGROUND

There are essentially two familiar types of bra adapted for sports use, namely, the compression type and the encapsulation type bra.

The compression type bra has a front portion, generally in the form of a band, which compresses the breasts to limit their movements and swaying.

This type of bra is felt as being uncomfortable by the users.

Furthermore, by compressing the breasts this type of bra can injure the breasts.

The encapsulation type bra comprises a first cup and a second cup to enclose each breast and thus act independently on the movements of each breast.

This type of bra does not compress the breasts and it respects the health of the breasts.

Whether of compression or encapsulation type, the bra comprises a front portion, in contact with the breasts, which is generally made by molding or by sewing.

By molding, the front portion of the bra is shaped by a molding process, such as thermal molding, of one or more materials, especially textile materials.

By sewing, the front portion of the bra is shaped by a traditional tailoring of one or more pieces of textile materials which are arranged according to their mechanical properties.

Furthermore, it is known how to reinforce the front portion by adding resin or accessories of framing type, regardless of the fabrication process.

These different types of bras, in order to be effective and adapted to athletic use, require a complex and difficult fabrication owing to the many materials used and their fabrication process.

SUMMARY

The present disclosure intends in particular to solve these inconveniences and in doing so it involves a bra adapted for athletic use, of the type comprising:

- a first cup and a second cup belonging to a front portion of the bra, each of them bounded laterally by an outer edge and by an inner edge, and
- a back fixation strap which is connected to the outer edge of the first cup and to the outer edge of the second cup, characterized in that each cup is outfitted with a support structure and a base structure, the support structure comprising at least one support strap of overall cradle shape which is elastically deformable and which extends at least from the outer edge to the inner edge of the associated cup, to support the breast.

The bra according to the disclosure makes it possible to limit the weight of the materials needed for its manufacture while still guaranteeing an effective supporting of the breasts.

Moreover, the elongated support elements, thanks to their slender shape and their elasticity, contribute to the comfort, the lightness, the aesthetics and the ergonomics of the bra.

According to one preferred embodiment, the support structure comprises at least one second support strap of overall cradle shape which is elastically deformable and which extends at least from the outer edge to the inner edge of the associated cup, to support the breast, the first strap and the second strap being arranged so as to cross and form a support meshing zone at each cup.

The crossing of the straps allows an interaction between the straps and makes it possible to create "fastening points" contributing to the supporting of the breasts.

Preferably, the meshing zone is arranged in at least a lower half of each cup.

According to another characteristic, the first support strap is formed from a first series of elongated elements which are elastically deformable and which extend in overall parallel manner to each other, and in that the second support strap is formed from a second series of elongated elements which are elastically deformable and which extend in overall parallel manner to each other.

Advantageously, the first strap is at least partly shared by the first cup and the second cup.

This characteristic favors the realization of the first strap.

According to another characteristic, the second support strap of the first cup and the second strap of the second cup form a central reinforcement zone in which said straps are crossed, said central reinforcement zone being arranged in an upper central part of said front portion of the bra, to support the breasts.

The crossing of the straps enables an interaction between the straps and makes it possible to create "fastening points" contributing to the supporting of the breasts.

Likewise, the bra has a plane of symmetry of general design extending vertically between the first cup and the second cup.

The disclosure also concerns a manufacturing process for a bra of the type comprising at least:

- an assembly step consisting in assembling the first strap and the second strap of the support structure on the base structure, and
- a molding step which consists in molding the assembly comprised of the base structure and the support structure, to form the front portion of the bra.

According to a first embodiment of the process, the assembly step consists in applying the first strap and the second strap to the base structure of the bra by silk screening.

According to a second embodiment of the process, the assembly step consists in assembling the front portion of the bra by superpositioning a front layer, a back layer, and an intermediate layer, the intermediate layer forming the internal support structure.

In this second embodiment, said layers are assembled by hot gluing.

According to a third embodiment of the process, the assembly step consists in embroidering the first strap and the second strap on the base structure of the bra.

According to a variant embodiment, the process involves a single molding stage which consists in simultaneously molding the base structure and the support structure to form the front portion of the bra.

BRIEF DESCRIPTION OF THE DRAWINGS

Other characteristics and advantages of the disclosure will appear from the perusal of the following detailed specification, referring to the enclosed drawings for its comprehension, in which.

In the present application, the terms "top", "bottom", "upper", "lower", and their derivatives refer to the position or the orientation of an element, this position or this orientation being considered when the bra is worn by a user standing upright.

Moreover, to clarify the specification and the claims, we shall use, in nonlimiting fashion, the terminology of longitudinal, vertical and transversal in regard to the trihedron L, V, T indicated in the figures.

In all of these figures, identical or analogous references represent identical or analogous elements or groups of elements.

DETAILED DESCRIPTION

Figure 1:
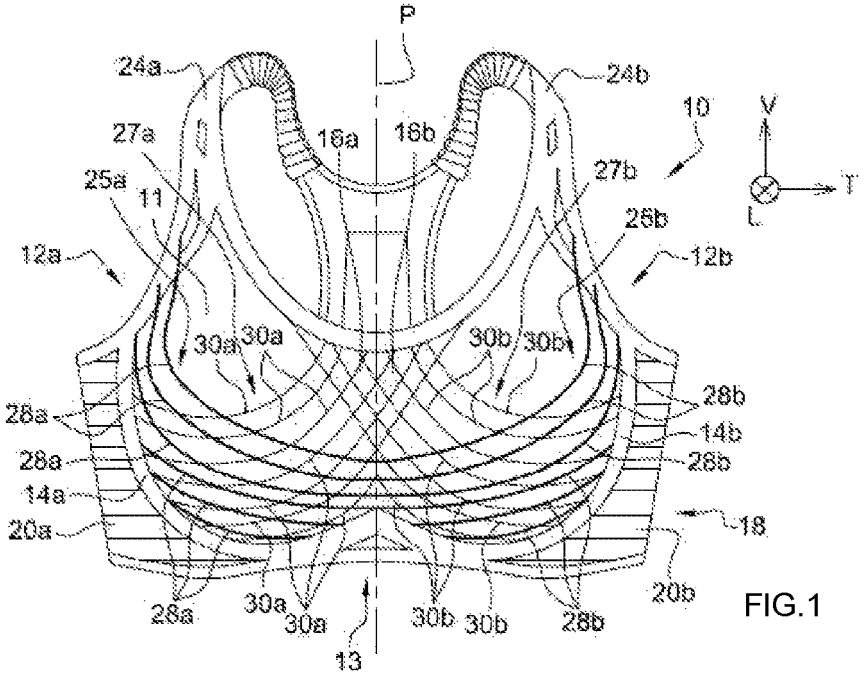
FIG. 1 is a front assembled view illustrating a bra whose cups are outfitted with elongated support elements according to the disclosure.

There is shown in FIG. 1 a bra 10 adapted for athletic use, being shown in a configuration as worn by a person standing upright.

The bra 10 has a first cup 12*a* and a second cup 12*b* which belong to a front portion 13 of the bra 10.

The two cups 12*a*, 12*b* are aligned transversely and arranged on either side of a plane of symmetry P of general layout of the bra 10, visible in FIG. 1.

To facilitate an understanding of the specification, the identical and symmetrical elements according to the plane of symmetry P are distinguished by a reference numeral followed by the letter "a" or "b".

Each cup 12*a*, 12*b* is bounded transversely by an outer edge 14*a*, 14*b* and by an inner edge 16*a*, 16*b*, respectively.

Moreover, each cup 12*a*, 12*b* has an overall hemispherical shape, with convexity oriented to the front in a longitudinal direction.

Figure 3:
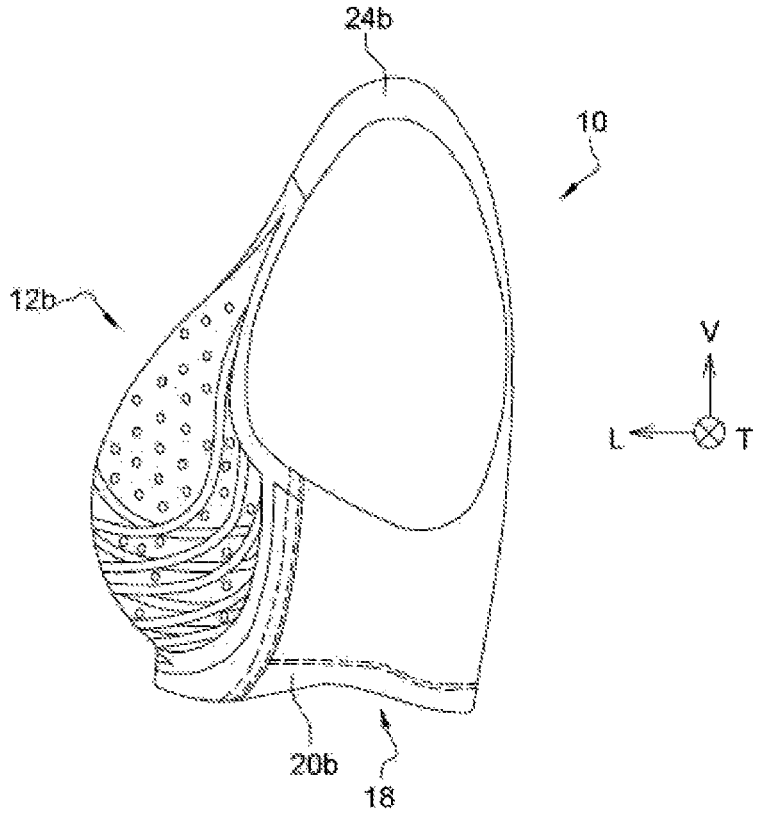
FIG. 3 is a profile view, illustrating the shape of the cups and the back fixation strap of the bra.

The bra 10 has a back fixation strap 18, visible in FIG. 3, which is composed here of a first web 20*a* and a second web 20*b* which can be connected to each other at the back of the person using the bra by a movable attachment means (not shown) of the type with a hook and complementary catches, for example.

The first web 20*a* of the fixation strap 18 is joined to the outer edge 14*a* of the first cup 12*a* and the second web 20*b* of the fixation strap 18 is joined to the outer edge 14*b* of the second cup 12*b*.

In a nonlimiting fashion, the bra 10 can also be designed for attachment in front, between the two cups 12*a*, 12*b*, according to a sample embodiment not represented.

Likewise, the bra 10 can be made into a tube without attachment means, to be slipped on over the head.

The back fixation strap 18 is made of knit which can stretch in a transverse direction corresponding to its long dimension, for example.

Moreover, the bra 10 is outfitted with a pair of suspenders (i.e., shoulder straps) 24*a*, 24*b* which are designed to support the bra 10 on the shoulders of the person wearing it.

According to the disclosure, each cup 12*a*, 12*b* is equipped with a support structure applied to a base structure 11 which forms the backbone of the bra 10. The base structure 11 is made of knit, for example.

The support structure of each cup 12*a*, 12*b* comprises a first support strap 25*a*, 25*b* and a second support strap 27*a*, 27*b*, respectively, each having an overall cradle shape, that is, a concave curved shape with concavity oriented overall toward the top.

The first straps 25*a*, 25*b* and the second straps 27*a*, 27*b* are elastically deformable and they extend from the outer edge 14*a*, 14*b* respectively of the associated cup 12*a*, 12*b*, to the inner edge 16*a*, 16*b* respectively of the associated cup 12*a*, 12*b*, in order to support the breasts.

Moreover, the first support straps 25*a*, 25*b* are formed by a first series of elongated elements 28*a*, 28*b* respectively, which are elastically deformable and which extend in overall parallel manner to each other, and the second support straps 27*a*, 27*b* are formed by a second series of elongated elements 30*a*, 30*b* respectively, which are elastically deformable and which extend in overall parallel manner to each other.

It is meant by elongated element, any slender element, such as a strap or a cord, for example.

Also, the elongated elements 28*a*, 28*b*, 30*a*, 30*b* can have different elasticities.

The elongated elements 28*a*, 28*b* of the first series, being six in number according to the sample embodiment described here, are superimposed and comprise three upper elongated elements 28*a*, 28*b* each of which has an upper piece 32*a*, 32*b* extending overall vertically from the base of the suspender 24*a*, 24*b*.

The upper pieces 32*a*, 32*b* thus constitute a support sling which works overall vertically as shown by the arrows F1, to support the cups 12*a*, 12*b* respectively, participating in the supporting of the breasts.

Figure 2:
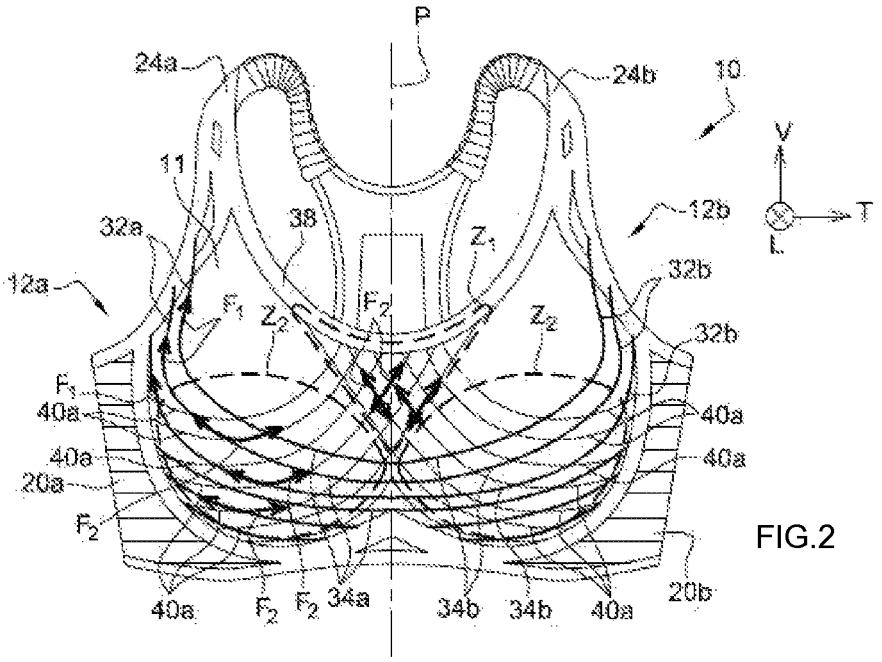
FIG. 2 is a front assembled view similar to that of FIG. 1, illustrating zones of action of the elongated elements.

Moreover, as can be seen in FIG. 2, the upper elongated elements 28*a*, 28*b* of the first series each have an inner piece 34*a*, 34*b* which extends overall transversely from the central plane of symmetry P, such that the upper elongated elements 28*a*, 28*b* of the first series are shared by the first cup 12*a* and the second cup 12*b*.

According to another aspect, the elongated elements 30*a*, 30*b* of the second series, likewise six in number according to the sample embodiment described here, are superimposed and comprise five elongated elements 30*a*, 30*b* each of them having an upper piece which extends in oblique manner from the neckline 38 of the bra 10, such that the upper pieces belonging to the first cup 12*a* and the upper pieces belonging to the second cup 12*b* form a central reinforcement zone Z1 in which these elongated elements are crossed in an X to promote the support at the center of the bra 10, as illustrated by the arrows F3.

Advantageously, each crossing of two elongated elements creates an anchoring point enabling an interaction between these two elongated elements to favor their mechanical strength.

As can be seen in FIG. 2, the upper elongated elements 30*a*, 30*b* of the second series each have an outer piece 40*a*, 40*b* which extends overall transversely to the straps 20*a*, 20*b* respectively.

According to another aspect of the disclosure, the elongated elements 28*a*, 28*b* of the first series and the elongated elements 30*a*, 30*b* of the second series are arranged so that they cross to form a first support meshing zone Z2 at the first cup 12*a* and, by symmetry, a second meshing zone Z2 at the second cup 12*b*.

Preferably, each meshing zone Z2 is arranged in at least a lower half of the associated cup 12*a*, 12*b*.

The crossing of two elongated elements 28*a*, 28*b*, 30*a*, 30*b* in each meshing zone Z1, Z2 produces an essentially cradle shape providing a bidirectional elasticity to each cup 12*a*, 12*b*, as illustrated by the arrows F2 in FIG. 2. This crossing makes it possible to increase the elastic rebound force of the elongated elements 28*a*, 28*b*, 30*a*, 30*b* so as to support the breasts and reduced the vertical movements.

The bra 10 according to the disclosure can be manufactured by a manufacturing process as described below.

The process involves an assembly step which consists in assembling the elongated elements 28*a*, 28*b*, 30*a*, 30*b* of the support structure on a base structure forming the backbone of the front portion 13 of the bra 10.

The assembly step is followed by a molding step which consists in molding the assembly comprised of the base structure and the support structure to form the front portion 13 of the bra 10.

The molding step is preferably accomplished by thermal molding, which makes it possible to give shape to the two cups 12*a*, 12*b* and reinforce the mechanical bonding between the base structure and the support structure.

According to a first embodiment of the process, the assembly step consists in applying the elongated elements 28*a*, 28*b*, 30*a*, 30*b* to the base structure of the bra 10 by silk screening.

According to this first embodiment of the process, the elongated elements 28*a*, 28*b*, 30*a*, 30*b* are preferably made of silicone, which makes it possible to lighten the bra while still providing a satisfactory elastic rebound.

As an example, the material used to manufacture the base structure of the front portion 13 of the bra 10 has a molding temperature lower than the melting temperature of the silicone so that the elongated elements 28*a*, 28*b*, 30*a*, 30*b* preserve their physical elasticity characteristics.

According to a preferred example, the base structure is made of knit of three-dimensional type, known as "3D knit", or of a three-dimensional monofilament separation fabric, composed of 89 percent polyamide fibers and 11 percent elastane fibers, and having a density of 375 grams per square meter.

According to a second embodiment of the process (not represented), the assembly step consists in assembling by hot gluing the front portion of the bra 10, involving a superpositioning of a front layer and a rear layer designed to be in contact with the skin, the front layer and the rear layer forming the base structure.

As a supplement, an intermediate layer is interposed between the front layer and the rear layer.

The intermediate layer here forms the internal support structure, the elongated elements 28*a*, 28*b*, 30*a*, 30*b* being cut in the intermediate layer for example in the form of thin strips by a laser cutting process.

According to this second embodiment of the process, the intermediate layer is preferably made of three-dimensional monofilament separation fabric of the type composed of 87 percent polyester fibers and 13 percent elastane fibers, and it has a density of 255 grams per square meter.

Likewise, the front layer is preferably made of jersey knit of the type composed of 80 percent polyamide fibers and 20 percent elastane fibers, and having a density of 80 grams per square meter.

Likewise, the rear layer is preferably made of jersey knit of the type composed of 78 percent polyamide fibers and 22 percent elastane fibers, and having a density of 330 grams per square meter.

According to a third embodiment of the process (not represented), the assembly step consists in embroidering the elongated elements 28*a*, 28*b*, 30*a*, 30*b* on the base structure of the bra 10.

The elongated elements 28*a*, 28*b*, 30*a*, 30*b* are, for example, elastically deformable cords or threads which are resistant to heat.

In fact, according to this third embodiment, the molding step of the assembly formed by the elongated elements 28*a*, 28*b*, 30*a*, 30*b* and the base structure is preferably carried out by thermal molding.

Finally, according to one variant of the previously described embodiments, the process involves a single molding step which consists in simultaneously molding the base structure 11 and the support structure made from a single piece of material in order to form the front portion 13 of the bra 10.

For this purpose, the base structure and the support structure of the bra 10 are placed for example in a mold and thermally molded together, so as to assemble them and shape them at the same time.

The present specification of the disclosure is given as a nonlimiting example.

The invention claimed is:

1. A bra comprising:

a first cup and a second cup belonging to a front portion of the bra, each of the first cup and the second cup bounded laterally by an outer edge and by an inner edge, and a back fixation strap connected to the outer edge of the first cup and to the outer edge of the second cup, wherein each cup includes a support structure and a base structure, the support structure of each cup comprising at least a first support strap having an overall cradle shape which is elastically deformable and which extends at least from the outer edge of the first cup to the outer edge of the second cup to support a breast of a wearer, and the support structure of each cup comprising at least a second support strap having an overall cradle shape which is elastically deformable and which extends at least from the outer edge to the inner edge of the respective cup to support the breast, the first support strap and the second support strap of each cup being arranged so as to cross and form a support meshing zone at each cup; and wherein the first support strap comprises a first series of elongated elements which are elastically deformable and which extend in an overall parallel manner to each other, and the second support strap comprising a second series of elongated elements which are elastically deformable and which extend in an overall parallel manner to each other.

2. The bra according to claim 1, wherein the support meshing zone is arranged in at least a lower half of each cup.

3. The bra according to claim 1, wherein the first support strap is at least partly shared by the first cup and the second cup.

4. The bra according to claim 1, wherein the second support strap of the first cup and the second support strap of the second cup form a central reinforcement zone in which the second support strap of the first cup and the second support strap of the second cup are crossed, the central reinforcement zone being arranged in an upper central part of the front portion of the bra, the central reinforcement zone configured to support the breasts of the wearer.

5. The bra according to claim 4, wherein the first series and the second series of elongated elements comprise silicone.

6. The bra according to claim 4, wherein the first series and the second series of elongated elements comprise elastically deformable cords or threads.

7. The bra according to claim 1, wherein the bra has a plane of symmetry extending vertically between the first cup and the second cup, wherein the support structure is symmetrical across the plane of symmetry.

8. The bra according to claim 1, wherein the first series and the second series of elongated elements comprise elastically deformable cords or threads.

9. The bra according to claim 8, wherein the first series and the second series of elongated elements comprise silicone.

10. The bra according to claim 9, wherein a material of the base structure of the front portion has a molding temperature lower than a melting temperature of the silicone.

11. The bra according to claim 1, wherein the first series and the second series of elongated elements comprise silicone.

12. The bra according to claim 1, wherein the base structure comprises a front layer and a rear layer, and the support structure comprises an intermediate layer interposed between the front layer and the rear layer.

13. The bra according to claim 12, wherein the first series and the second series of elongated elements comprise cut strips of the intermediate layer.

14. The bra according to claim 13, wherein the first series and the second series of elongated elements comprise thin, laser cut strips of the intermediate layer.

15. The bra according to claim 12, wherein the intermediate layer comprises three-dimensional monofilament separation fabric.

16. A bra comprising:

a first cup and a second cup belonging to a front portion of the bra, each of the first cup and the second cup bounded laterally by an outer edge and by an inner edge, and a back fixation strap connected to the outer edge of the first cup and to the outer edge of the second cup, wherein each cup includes a support structure and a base structure, the support structure of each cup comprising at least a first support strap having an overall cradle shape which is elastically deformable and which extends at least from the outer edge of the first cup to the outer edge of the second cup to support a breast of a wearer, and the support structure of each cup comprising at least a second support strap having an overall cradle shape which is elastically deformable and which extends at least from the outer edge to the inner edge of the respective cup to support the breast, the first support strap and the second support strap of each cup being arranged so as to cross and form a support meshing zone at each cup; and wherein the second support strap of the first cup and the second support strap of the second cup form a central reinforcement zone in which the second support strap of the first cup and the second support strap of the second cup are crossed, the central reinforcement zone being arranged in an upper central part of the front portion of the bra, the central reinforcement zone configured to support the breasts of the wearer.

17. The bra according to claim 16, wherein the support meshing zone is arranged in at least a lower half of each cup.

18. The bra according to claim 16, wherein the first support strap is at least partly shared by the first cup and the second cup.

19. The bra according to claim 16, wherein the bra has a plane of symmetry extending vertically between the first cup and the second cup, wherein the support structure is symmetrical across the plane of symmetry.

20. The bra according to claim 16, wherein the first support strap comprises a first series of elongated elements which are elastically deformable and which extend in an overall parallel manner to each other, and the second support strap comprises a second series of elongated elements which are elastically deformable and which extend in an overall parallel manner to each other, and the first series and the second series of elongated elements comprise elastically deformable cords or threads.

21. The bra according to claim 20, wherein the first series and the second series of elongated elements comprise silicone.

22. The bra according to claim 21, wherein a material of the base structure of the front portion has a molding temperature lower than a melting temperature of the silicone.

23. The bra according to claim 16, wherein the first support strap comprises a first series of elongated elements which are elastically deformable and which extend in an overall parallel manner to each other, and the second support strap comprising a second series of elongated elements which are elastically deformable and which extend in an overall parallel manner to each other, and the first series and the second series of elongated elements comprise silicone.

24. The bra according to claim 16, wherein the base structure comprises a front layer and a rear layer, and the support structure comprises an intermediate layer interposed between the front layer and the rear layer.

25. The bra according to claim 24, wherein the support structure comprises cut strips of the intermediate layer.

26. The bra according to claim 25, wherein the support structure comprises thin, laser cut strips of the intermediate layer.

27. The bra according to claim 24, wherein the intermediate layer comprises three-dimensional monofilament separation fabric.

* * * * *